US008790495B2

(12) United States Patent
Tran et al.

(10) Patent No.: US 8,790,495 B2
(45) **Date of Patent: *Jul. 29, 2014**

(54) WEB PRODUCTION WITH INCREASED PROCESS EFFICIENCY

(75) Inventors: Peter Q. Tran, Dublin, OH (US); Kevin D. Starr, Lancaster, OH (US); Timothy A. Mast, Plain City, OH (US); Timothy F. Murphy, Columbus, OH (US)

(73) Assignee: ABB Ltd., Dublin (IE)

( * ) Notice: Subject to any disclaimer, the term of this patent is extended or adjusted under 35 U.S.C. 154(b) by 744 days.

This patent is subject to a terminal disclaimer.

(21) Appl. No.: 12/403,998

(22) Filed: Mar. 13, 2009

(65) Prior Publication Data

US 2009/0229777 A1 Sep. 17, 2009

Related U.S. Application Data

(60) Provisional application No. 61/037,023, filed on Mar. 17, 2008.

(51) Int. Cl.
*D21F 11/00* (2006.01)
*D21G 9/00* (2006.01)

(52) U.S. Cl.
CPC ..... *D21G 9/0027* (2013.01)
USPC ..... 162/198; 162/252; 700/129

(58) Field of Classification Search
USPC ..... 162/198, 252; 700/129
See application file for complete search history.

(56) References Cited

U.S. PATENT DOCUMENTS

| | | | | |
|---|---|---|---|---|
| 4,965,736 | A | 10/1990 | Balakrishnan | |
| 5,093,795 | A | 3/1992 | Lewis | |
| 5,262,955 | A * | 11/1993 | Lewis | 700/129 |
| 7,146,238 | B2 * | 12/2006 | Burma | 700/127 |
| 7,300,548 | B2 * | 11/2007 | Tran et al. | 162/198 |
| 7,648,614 | B2 * | 1/2010 | Tran et al. | 162/263 |
| 8,092,650 | B2 | 1/2012 | Munch | |
| 2002/0011319 | A1 * | 1/2002 | Shakespeare et al. | 162/253 |
| 2003/0000669 | A1 * | 1/2003 | Strand et al. | 162/198 |

* cited by examiner

*Primary Examiner* — Jacob Thomas Minskey
(74) *Attorney, Agent, or Firm* — Michael C. Prewitt; Melissa J. Szczepanik

(57) ABSTRACT

A conservation control system is provided for integration with an cross-direction controller on a sheet making machine. The conservation control system receives inputs from the cross-direction controller and accepts and/or modifies the controller commands to a profiler based on desired performance and conservation trade-offs.

13 Claims, 13 Drawing Sheets

CD PROFILING RESOURCE CONSERVATION CONTROL

Existing Feedback CD Control

$\underline{u}_s = \underline{u}_m$

| | | Resource Control Off | Resource Control On | Result |
|---|---|---|---|---|
| **ReWet CD Control** | Avg. Moisture Profile Variability (2-sigma) | 0.6 %M | 0.68 %M | 13% increase |
| | Avg. Rewet Profiler Output | 24.06 %Output | 14.74 %Output | 39% reduction in resource usage |
| | Avg. MD Steam Section Output | 134.48 psi | 123.32 psi | 8% reduction in resource usage |
| **Steam CD Control** | Avg. Moisture Profile Variability (2-sigma) | 0.68 %M | 0.67 %M | 1% reduction |
| | Avg. Steam Profiler Output | 42.59 %Output | 36.09 %Output | 15% reduction in resource usage |

Figure 10

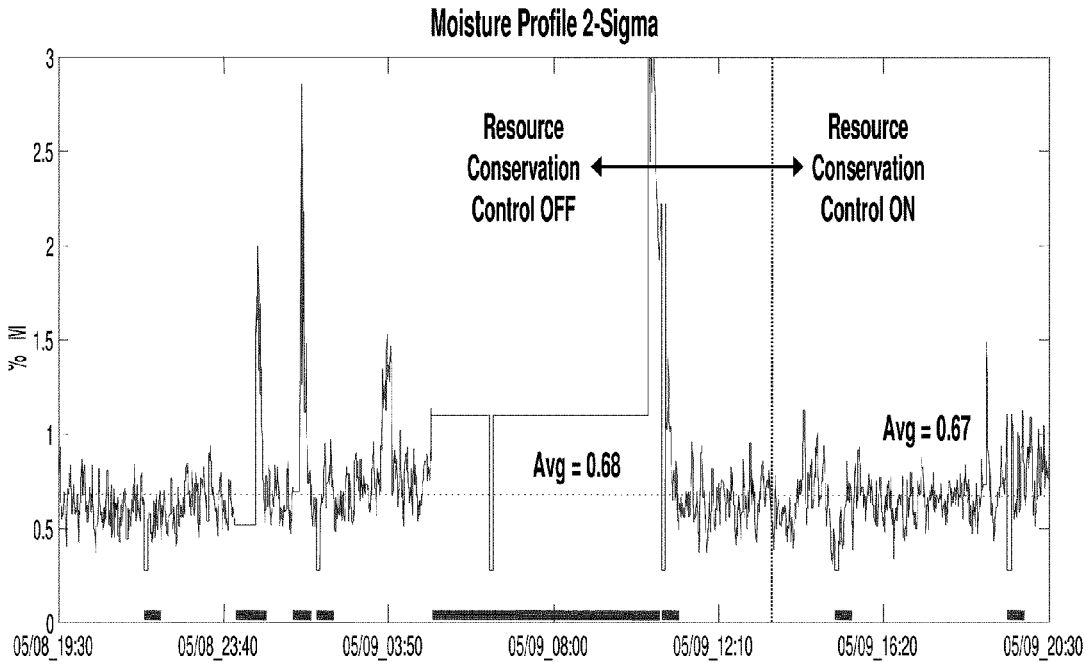
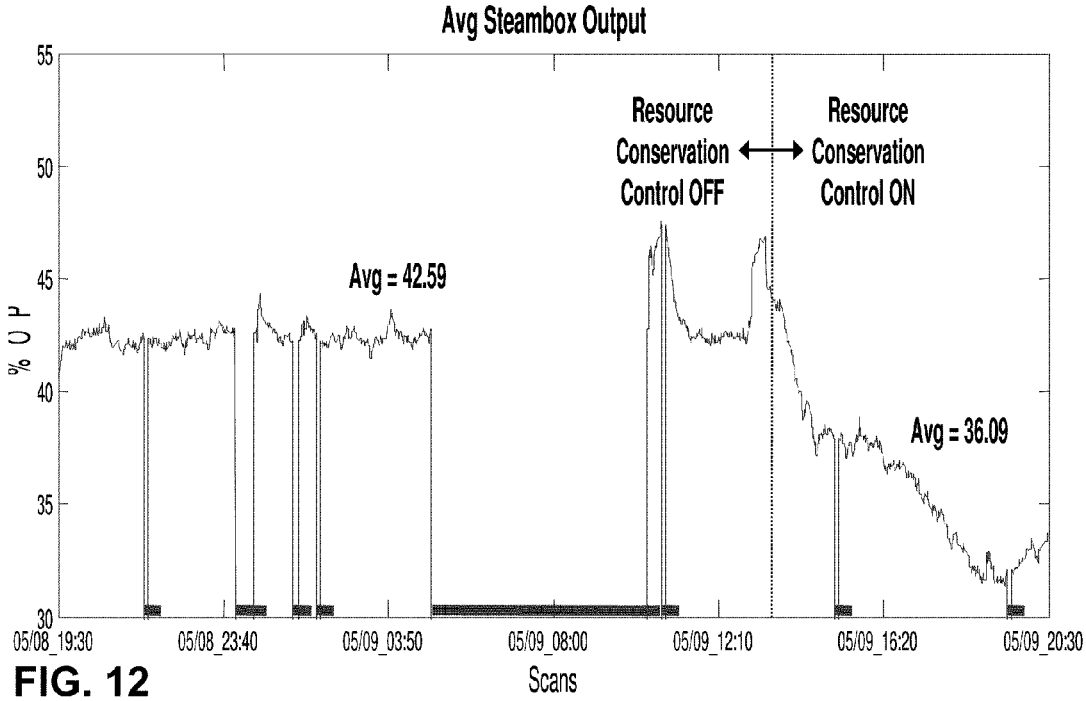
FIG. 12

WEB PRODUCTION WITH INCREASED PROCESS EFFICIENCY

CROSS-REFERENCE TO RELATED APPLICATION

This application claims the benefit of U.S. Provisional Patent Application No. 61/037,023, titled Web Production with Increased Process Efficiency and filed on Mar. 17, 2008, which is hereby incorporated by reference in its entirety.

TECHNICAL FIELD

The present invention relates generally to web forming processes and more particularly to improved efficiency during cross-machine direction moisture control.

BACKGROUND

Modern paper making production lines operate at very high speeds, and must be actively controlled to achieve acceptable uniformity. During production, it is important to maintain uniform cross-machine direction (CD) weight, moisture, and caliper profiles. In particular, non-uniform CD moisture profiles affect the final paper quality and converting operations by causing dimensional instability, curling and wrinkling of the paper sheet. A non-uniform CD moisture profile could also affect running performance of the paper machine by increasing the risk of sheet breaks. Modulation of the moisture profile can be achieved either by, for example, manipulating steam, water, or infrared energy output onto the sheet, with the latter being more prevalent with coated paper applications.

Modern paper making machines include control systems that control many components, including profiling devices. When actuated, these profiling devices can affect the CD moisture profile of the web by applying steam, water or infrared energy. Of course, the operation of profiling devices increases the manufacturing costs. In the case of water addition from rewet profilers, operating cost includes water purification, increased steam usage in the dryer section because the sheet must be over-dried before rewetting the sheet, reduced production because less steam is available in the dryer section, and seasonal availability or cost of water in some regions. In the case of steam addition from steam profilers, operating cost includes production of superheated steam. In the case of infrared energy output from infrared profilers, operating cost includes gas or electric usage for generating infrared energy. Thus, generally the greater the uniformity, the greater the use of the profiling devices and consequently, the greater the operating costs.

The efficient production of webs with quality profiles is further complicated when multiple CD profiling devices are employed to control the same profile measurement. This multiple profiling device arrangement is often employed to achieve maximum flexibility and responsiveness. However, multiple profiling devices may work against one other and cause more total expenditure of resources than is necessary.

There is therefore a need in the art for a method of controlling CD moisture that achieves greater efficiency while maintaining acceptable uniformity.

SUMMARY OF THE INVENTION

According to one embodiment of the present invention, a conservation control method is provided for integration with a feedback cross-machine direction control system. The feedback cross-machine direction control system includes a cross-machine direction controller and a cross-machine direction profiler for affecting the properties of a web being produced in the machine direction. The conservation control method may include receiving an error profile representing a web property, the error profile including a plurality of cross-direction zones. A first cross-direction set-point array is received from the feedback cross-direction controller, the first cross-direction set-point array including a plurality of first set-point values, each first set-point value correlating to one of the cross-direction zones. A performance band is determined. A decision array is created having a plurality of decision array values, where each decision array value correlates to one of the cross-direction zones, and for each cross-direction zone if the error profile is outside the performance band, the decision array value correlating to that cross-direction zone is set to accept. If the error profile is inside the performance band, the decision array value correlating to that cross-direction zone is set to reject. A modified cross-direction set-point array is created, the modified cross-direction set-point array includes a plurality of modified set-point values, each of the modified set-point values correlating to one of the cross-direction zones. For every cross-direction zone labeled accept in the decision array, the corresponding modified set-point value is set to the first set-point value correlating to that cross-direction zone and for every cross-direction zone labeled reject in the decision array, the corresponding modified set-point value is set to a previously stored set-point value. The modified cross-direction set-point array is then transmitted to the cross-direction profiler.

According to another embodiment of the present invention, a conservation control system is provided for integration with a feedback cross-machine direction control system. The feedback cross-machine direction control system includes a cross-machine direction controller and a cross-machine direction profiler for affecting the properties of a web being produced in the machine direction. The conservation control system includes an evaluate error profile module for receiving an error profile representing a web property. The error profile includes a plurality of cross-direction zones. The evaluate error profile module receives a first cross-direction set-point array from the feedback cross-direction controller, the first cross-direction set-point array includes a plurality of first set-point values, each of the first set-point values correlating to one of the cross-direction zones. The evaluate error profile module further receives a performance band, the evaluate error profile module is adapted to create a decision array having a plurality of decision array values. Each decision array value correlates to one of the cross-direction zones, and for each cross-direction zone if the error profile is outside the performance band, the decision array value correlating to that cross-direction zone is set to accept. If, however, the error profile is inside the performance band, the decision array value correlating to that cross-direction zone is set to reject. An individual cross-direction zone set-point chooser creates a modified cross-direction set-point array. The modified cross-direction set-point array includes a plurality of modified set-point values, each of the modified set-point values correlating to one of the cross-direction zones. For every cross-direction zone labeled accept in the decision array, the corresponding modified set-point value is set to the first set-point value correlating to that cross-direction zone. For every cross-direction zone labeled reject in the decision array, the corresponding modified set-point value is set to a previously stored set-point value. The individual cross-direction zone set-point chooser is adapted to transmit the modified cross-direction set-point array to the cross-direction profiler.

According to still another embodiment of the present invention, a conservation control method is provided for integration with a feedback cross-machine direction control system. The feedback cross-machine direction control system includes a cross-machine direction controller and a cross-machine direction profiler for affecting the properties of a web being produced in the machine direction. The conservation control method includes, receiving an error profile having a plurality of cross-direction zones. A set of first cross-machine set-points is received from the feedback cross-machine direction controller. A set of modified cross-machine set-points is output to the cross-machine direction profiler, wherein if the error profile for a given cross-direction zone is outside a predetermined range, the corresponding set-point in the modified cross-direction set-points is the value of the corresponding set-point in the first cross-machine set-points and if the error profile for a given cross-direction zone is inside the predetermined range, the corresponding set-point in the modified cross-direction set-points is set to a previously stored value. The modified cross-direction set-points are then transmitted to the cross-direction profiler.

BRIEF DESCRIPTION OF THE DRAWINGS

FIG. 10 shows a chart displaying improved efficiency when with operation of the conservation control.

FIG. 12 shows performance trends indicative of the operation of a paper making machine employing the conservation control of the present invention, where a corresponding reduction in steam output from a steam profiler is achieved while the moisture profile performance is maintained.

DETAILED DESCRIPTION OF THE INVENTION

Figure 1:
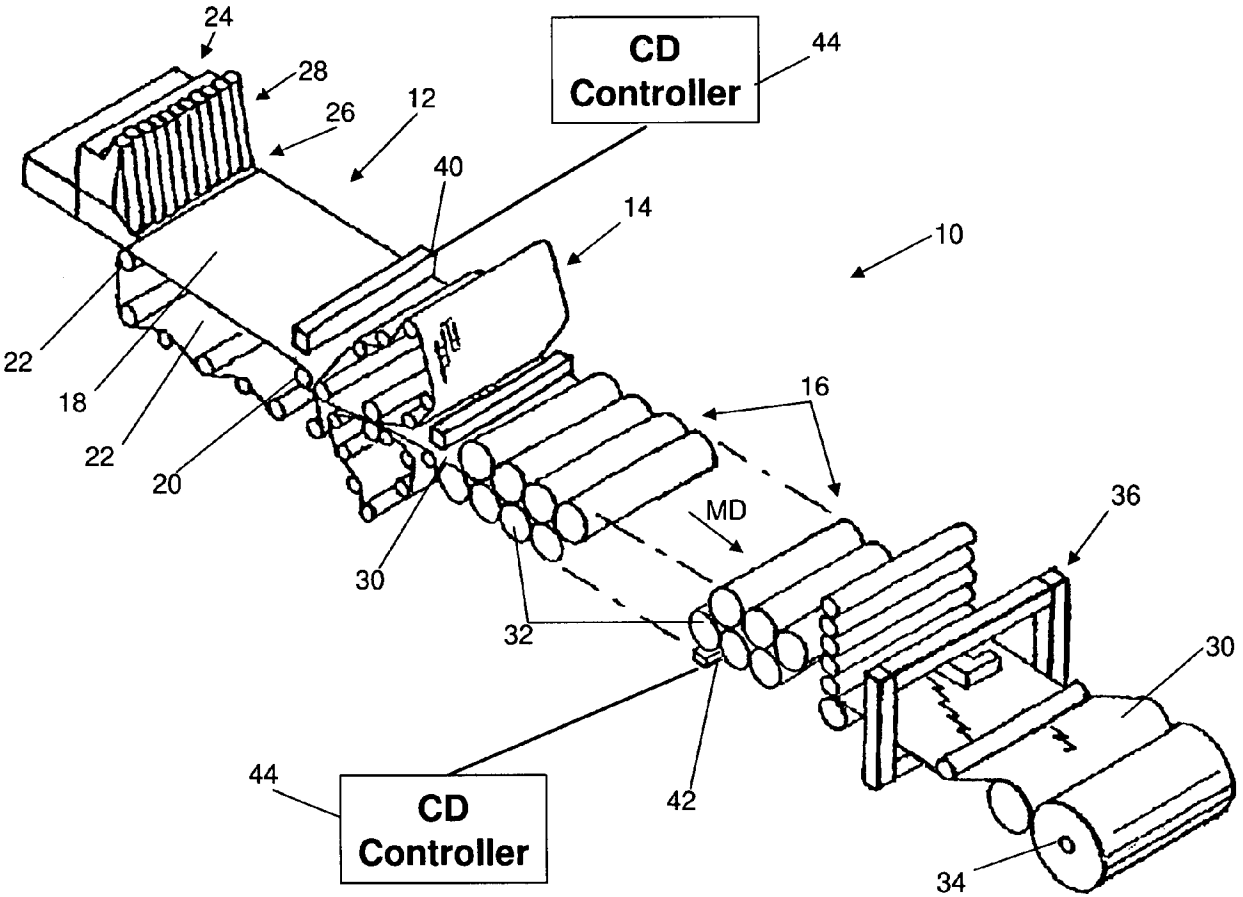
FIG. 1 shows an exemplary paper making machine.

A paper making machine is shown in FIG. 1, and generally indicated by the numeral 10. The machine 10 includes a wire section 12, a press section 14, a dryer section 16 having its midsection broken away to indicate that other web processing equipment, such as a sizing section, additional dryer sections and other equipment, may be included within the machine 10.

The wire section 12 includes an endless wire belt 18 wound around a drive roller 20 and a plurality of guide rollers 22 properly arranged relative to the drive roller 20. The drive roller 20 is driven for rotation by an appropriate drive mechanism (not shown) so that the upper side of the endless wire belt 18 moves in the direction of the arrow labeled MD that indicates the machine direction for the process. A head-box 24 receives pulp slurry (i.e. paper stock), that is discharged through a slice lip 26, controlled using a plurality of actuators 28. The pulp slurry is drained of water on the endless wire belt 18 to form a web 30 of paper.

The web 30 so formed is further drained of water in the press section 14 and is delivered to the dryer section 16. The dryer section 16 includes a plurality of steam-heated drums 32. The web 30 may be processed by other well known equipment located in the MD along the process and is ultimately taken up by a web roll 34. Equipment for sensing characteristics of the web 30, illustrated as a scanning sensor 36, is located close to the web roll 34. In other words, sensor 36 is positioned proximate to the end of the paper making process. For purposes of the present invention, any form of sensing equipment can be used so long as it is capable of monitoring the relevant characteristics along the entire CD width of the paper with sufficient resolution.

The web CD moisture profile is controlled by adding water, steam and/or infrared energy at localized regions across the sheet. These substances are applied in different amounts at each of the localized regions to reduce deviation of the moisture profile from a target reference shape. The device used to add these resources is called a cross-direction (CD) profiler, and the localized regions across the sheet on the CD profiler are called CD zones. The exemplary paper making machine 10 includes a first CD profiler 40 in the form of a steam profiler and a second CD profiler 42 in the form of a rewet profiler. It should be appreciated that, though the preferred embodiment includes two CD profilers, any number may be used. Each profiler 40/42 communicates with and is controlled by a controller 44. The number of CD zones on the CD profiler defines the control granularity or the control bandwidth for the CD profiler.

CD moisture control is performed for the purpose of reducing variability in the profile error. Reduction in variability improves product quality and machine runnability. The profiling devices used in conjunction with a feedback CD control have direct and indirect operating costs. Direct operating costs include those associated directly with operating the CD profiler and indirect operating costs are those associated with interaction of the CD profiler with the rest of the paper machine's operation. This indirect contact could lead to increased paper machine operating costs beyond the direct costs.

Depending on the paper manufacturing application, moisture profile control can be applied in a number of different configurations. In general, a single moisture profile measurement instance (e.g. Moisture profile monitored at sensor 36) can be controlled with a single profiler unit or multiple profiler units at the same time.

In a single profiler configuration, the direct operating cost associated with performing CD moisture control is associated with operating the single profiler unit and the indirect operating cost is any consequential effects of the profiler on the paper making process. For example, CD moisture control with a rewet profiler has the associated direct operating cost of operating the rewet profiler and the indirect consequential operating cost caused by the increase in average moisture in the sheet. When the average moisture is increased, it is necessary for feedback machine-direction (MD) moisture control to over-dry the sheet by using more steam in the dryer sections in order to balance out the addition of water from the rewet profiler. The indirect consequential operating cost does not stop with the increase usage of steam in the dryer sections but may extend to reduction in the production rate if the paper machine is steam limited in the dryer sections. In the case of steam or infrared profiling, the direct operating cost may be higher than the rewet profiler because of the energy needed to generate the profiling resources (ie. steam and infrared energy) used by the profiler. However, the indirect operating cost may offset some of the added cost because these profilers provide the benefit of decreasing the average sheet moisture thus help reduce steam usage in the dryer section.

In a multiple profiler configuration, as shown in FIG. 1, more than one CD profiler unit is used to control the same moisture profile measurement. The most common configuration is the use of a rewet profiler 42 and a steam profiler 40 at the same time. In this case, the rewet and the steam profilers affect the moisture profile in opposing direction. The rewet profiler increases dry regions in the profile, while the steam profiler decreases wet regions in the profile. This opposing interaction can cause the rewet and steam profilers to counteract each other, thus leading to higher average output from both profiling devices.

While profile error variability reduction is important, limiting the operating cost is equally important. Depending on the paper mill's production goals and machine operating constraints, the ability to balance product quality and operating cost is important. This balancing act is a trade-off between profiler error variability and operating cost.

The present invention provides a logic-based control that may be added to a control system to complement the feedback CD control. The control method of the present invention is a decision making control that accepts or rejects the control set-points calculated by the feedback CD control. In this relationship, the feedback CD control serves the primary role of periodically monitoring a feedback measurement of a key process property, as an example the sheet moisture profile, and computing corrective actions to remove any deviation that exists between the feedback measurement and a target reference. The computed corrective action from the feedback CD control is sent to a profiling device having an array of actuation elements that is designed to influence the key process property, as an example a rewet or a steam profiler. The corrective actions of the feedback CD control may operate in a manner as described in the paper entitled "Adaptive Profile Control for Sheetmaking Processes" by S.-C. Chen, R. M. Synder and R. G. Wilhelm, Jr. which was presented at the $6^{th}$ International IFAC/IFIP/IMEKO Conference on Instrumentation and Automation in the Paper, Rubber, Plastics and Polymerization Industries (PRP-6), held on Oct. 27-29, 1986 in Akron, Ohio, which is hereby incorporated by reference.

Figure 2:
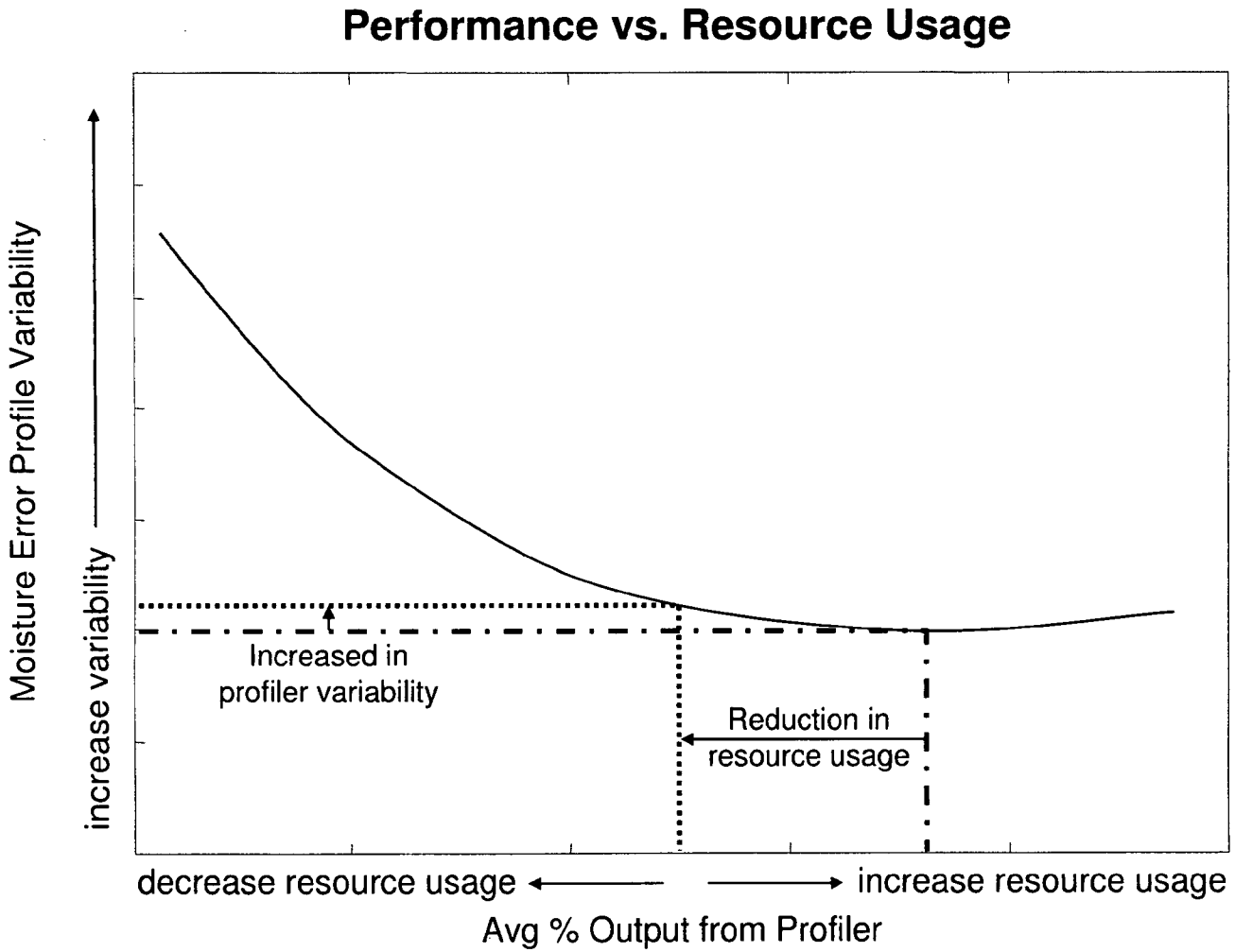
FIG. 2 shows a performance vs. resource usage chart.
Figure 3A:
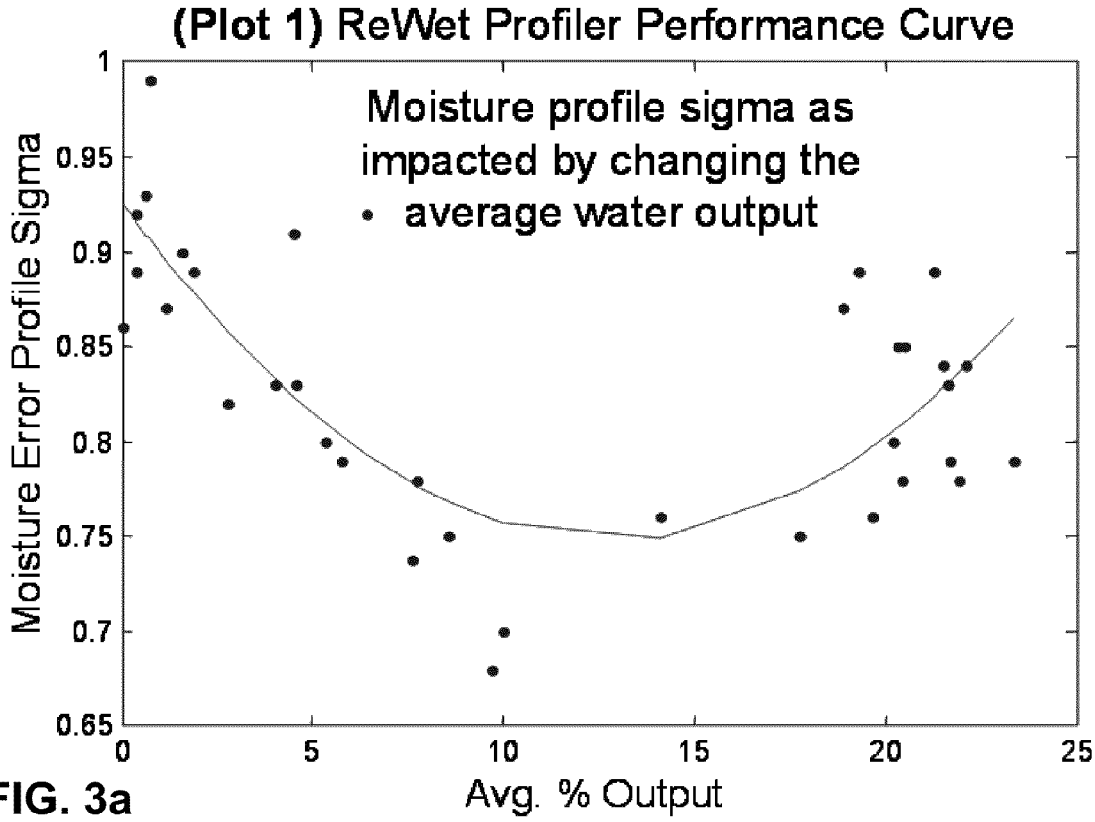
FIG. 3 shows a plurality of plots related to rewet and steam profiler performance.
Figure 3B:
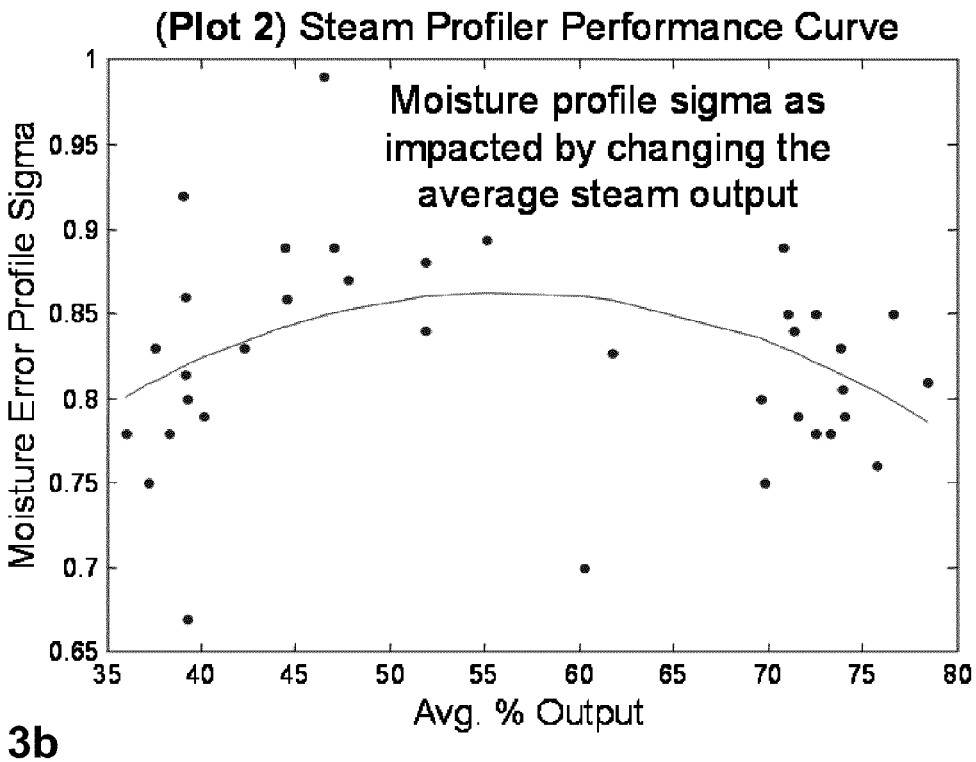
Figure 3C:
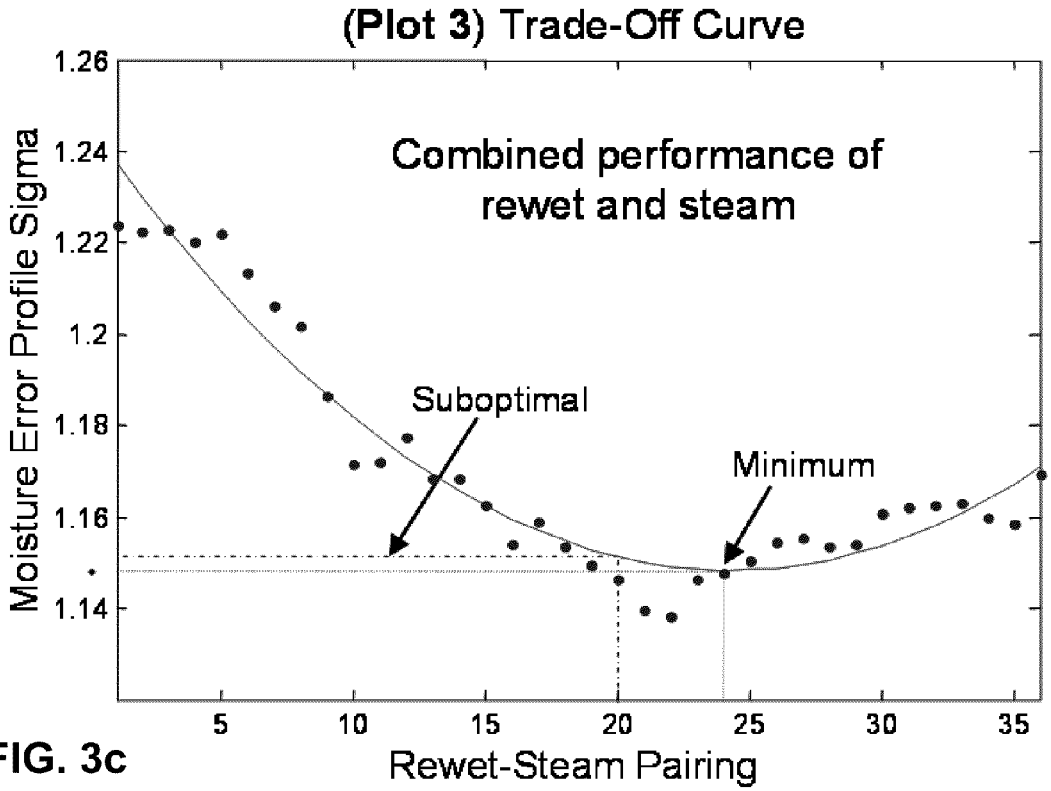
Figure 3D:
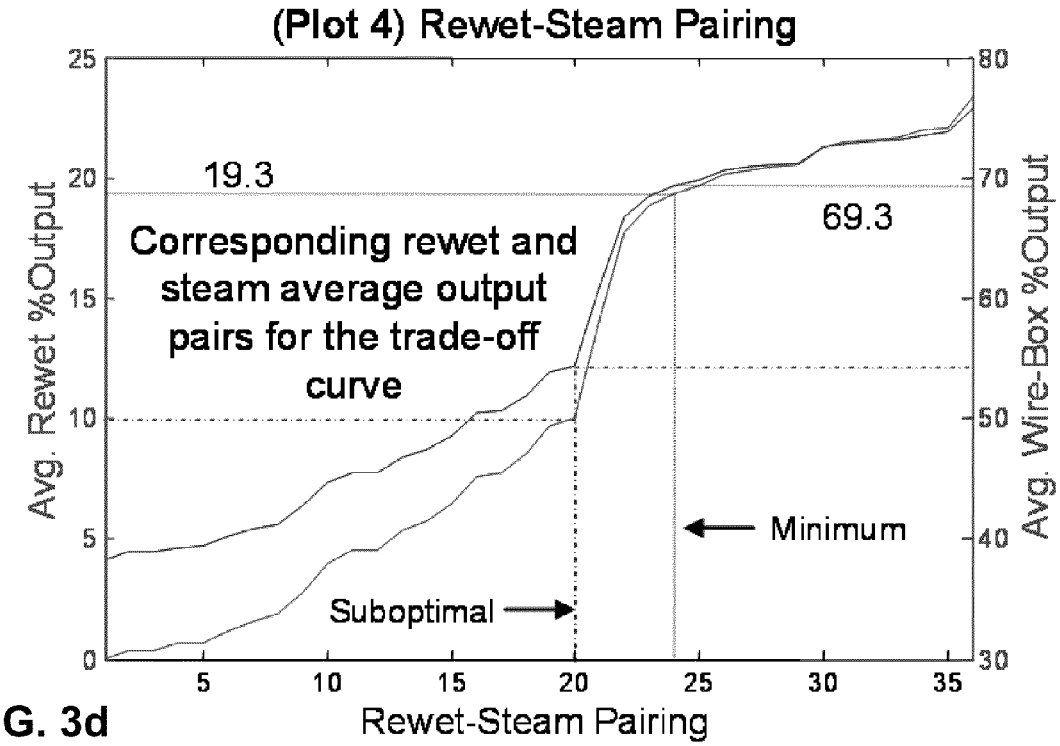

A comparison of CD moisture control performance versus CD profiling expenditures may be visualized by plotting a measure of the sheet property profile quality against resource usage for the CD profiler. With particular reference to paper web production, it is customary to evaluate the quality of a sheet profile property (i.e. weight, moisture, or caliper) by first computing the difference profile between the sensor measurement profile and a target reference and then computing the standard deviation of this difference profile. The standard deviation value of the difference profile is the customary measure of quality of a sheet profiler property. According to this measure of profile quality, a standard deviation value approaching zero indicates the sheet property profile measurement is nearly equal to the target reference. Such a measurement indicates that the control performance is very good. As a measure of resource usage for the CD profiler, the average output from all the CD zones of a CD profiler is a direct indicator of resource usage and can be easily calculated. The average output may be as a percentage ranging from 0 to 100. An average output that approaches 0 means the resource usage is decreasing towards zero usage, while an average output that approaches 100 means the resource usage is increasing towards maximum possible usage. Using these two measures, the trade-off curve for CD moisture control performance verses any of the above described CD moisture profiling devices will appear as shown in FIG. 2, which represents a system wherein the moisture profile is controlled with a single actuator device.

In the above referenced figure, the x-axis is the average output from the CD profiler and the y-axis is the profile standard deviation. With respect to the x-axis, a shift to the left indicates the profiler output is decreasing, while a shift to the right indicates the profiler output is increasing. With respect to the y-axis, shift up the axis indicates the error profile variability is increasing and the control performance is degrading. The asymptotic slope of the trade-off curve shows how much control performance is forfeited per amount of resource savings. If the trade-off curve is shallow near the minimum error profile variability point, a large savings in profiling resources may be gained with only a slightly higher error profile variability level.

For a paper machine where multiple CD profilers are employed to control the same measurement profile, the trade-off curve is multi-dimensional. To construct this trade-off curve, it is necessary to know how the error profile variability is impacted when the average output of one profiler device is gradually reduced while the other device continues to operate under normal feedback CD control. One method of constructing the trade-off curve for a two profiler configuration includes the following steps:

(1) Turn off feedback CD control for a first profiler
(2) Leave on feedback CD control for the second profiler
(3) Gradually reduce the average output to the first profiler in such a way as to diminish the control output from each profiling control zone by the same magnitude. Since profile control is performed with an array of control zones, the equal magnitude reduction in output at each zone ensures that the relative set-point relationship between consecutive control zones is maintained to minimize disturbances to the profile measurement.
(4) Collect the average output from each of the two profilers and the error profile variability Steps (3) and (4) are repeated until the average output to the first profiler is at zero. The collected error profile variability and average output to each of the two profilers are grouped so that each error profile variability value has a corresponding average output to each of the profilers. Once this grouping is made, the plots of FIG. 3 may be created. Plots 1 and 2 show the raw data collected from the trade-off test, where plot 1 shows the error profile variability versus the average rewet output and plot 2 shows the error profiler variability versus the average steam output. Plot 3 is the trade-off curve which shows the grouping of the data collected where the y-axis is the error profile variability value and the x-axis is the pairing number used to identify the average rewet output and average steam output that resulted in the error profile variability value. This plot is similar to the trade-off curve for the single profiler configuration with the exception that the x-axis represents a paired solution. Finally, plot 4 shows the individual average output to the profilers for the corresponding pairing number.

Plots 3 and 4 show that the minimum error profile variability is achieved by outputting a lot of water and steam onto the sheet. However, because the trade-off curve is shallow near the minimum error profile variability point, a large reduction in both water and steam output can be achieved by settling for an acceptable, but slightly higher error profile variability. The curvature of plots 3 and 4 may be operating point dependent and may change with different production recipes.

Figure 4:
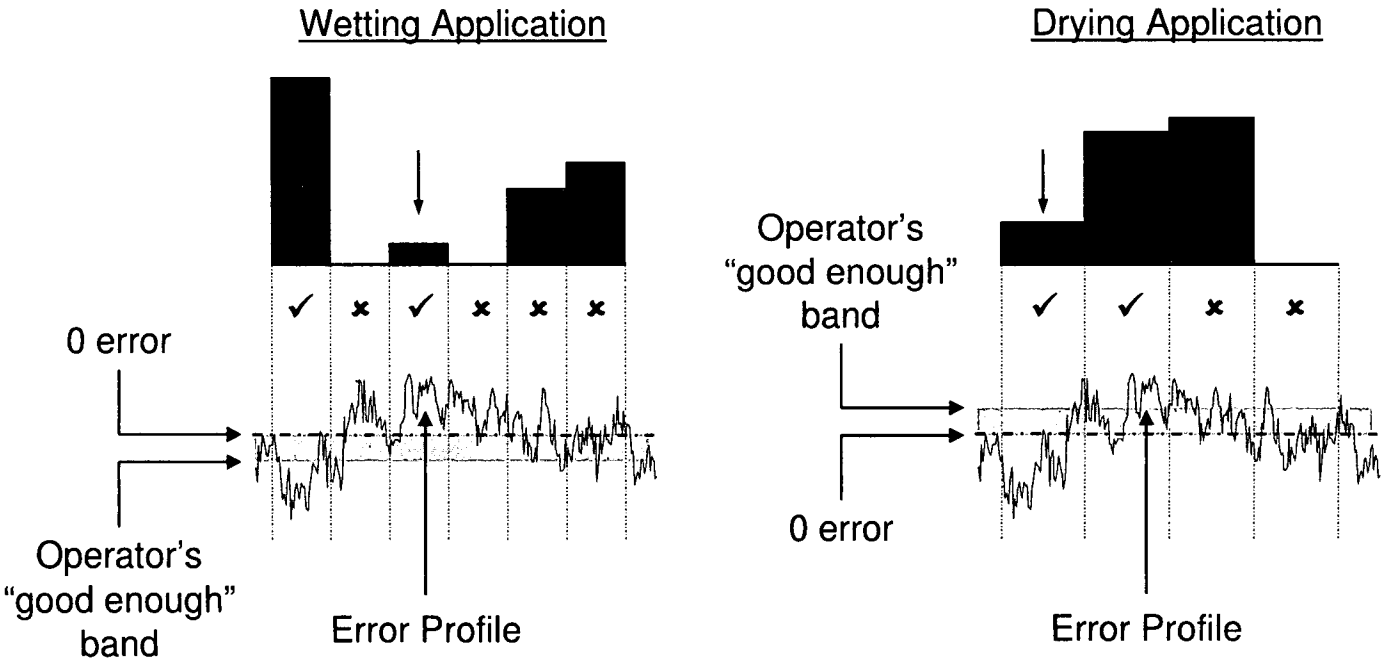
FIG. 4 shows an error profile for wetting and drying applications.

Existing feedback control algorithms make changes to CD profiler set-points in an effort to reduce the profiler error. The present invention enables the profiler set-points to be changed only when the error magnitudes are greater than some tolerable level. For example, with reference to FIG. 4, if the CD profiler is a rewet application, the present invention allows changes in profiler set-points only when the error magnitudes are outside the "good enough" band, thus adding water to profile regions that are too dry while reducing or shutting off output to profile regions that are wet. If the CD profiler is a steam or infrared application, the present invention allows changes to the profiler set-points only when the error magnitudes are outside the "good enough" band, thus adding steam or energy to profile regions that are too wet while reducing or shutting off the output to profile regions that are dry.

Feedback control algorithms have integral control actions, which are made in direct proportion to the error magnitude. The control actions are a necessary functionality of feedback control algorithms because they eliminate target offsets. Currently existing feedback CD control algorithms include the necessary functionality to eliminate profile error. The control design of the present invention functions symbiotically with feedback CD control algorithms by monitoring the profile error magnitude, the newly calculated set-points and previous set-points. The control design of the present invention implements the "good enough" decision to accept or reject the newly calculated set-points from feedback CD control. Thus, as will hereinafter discussed, the control design of the present invention may be applied to work with the existing feedback CD controls.

The CD moisture profiling resource conservation control of the present invention (hereinafter "conservation control") is a logic-based control that complements any existing feedback CD moisture control. Logical rules accomplishing the "good enough" judgment are implemented in this logic-based control to decide whether a feedback CD control command will be applied to the CD zones of a profiler or whether the set-point for the CD profiler zones will be kept at the previous value. The control logic of the present invention is complementary to the normal CD feedback control action. Thus, if it is desired to turn the conservation control "off", the logic may be set to always apply the newly computed automatic feedback control action of the feedback CD control, which allows the feedback CD control to operate uninterrupted.

The conservation control analyzes the control set-points immediately after the feedback CD control executes. On the same control execution step, each CD zone is evaluated individually and the decision for each CD zone is exclusive. As such, the conservation control does not need the architecture necessary to implement a feedback control.

The conservation control is adapted for one-to-one integration with a feedback CD control. In the case of multiple feedback CD controls manipulating separate CD profiler systems, then one conservation control module may be associated with each of the feedback CD controls. Each conservation control operates independent of the others. By way of tuning parameters defined for the conservation control, each is configured to perform a "good enough" judgment that is appropriate for its corresponding CD profiler.

Figure 5:
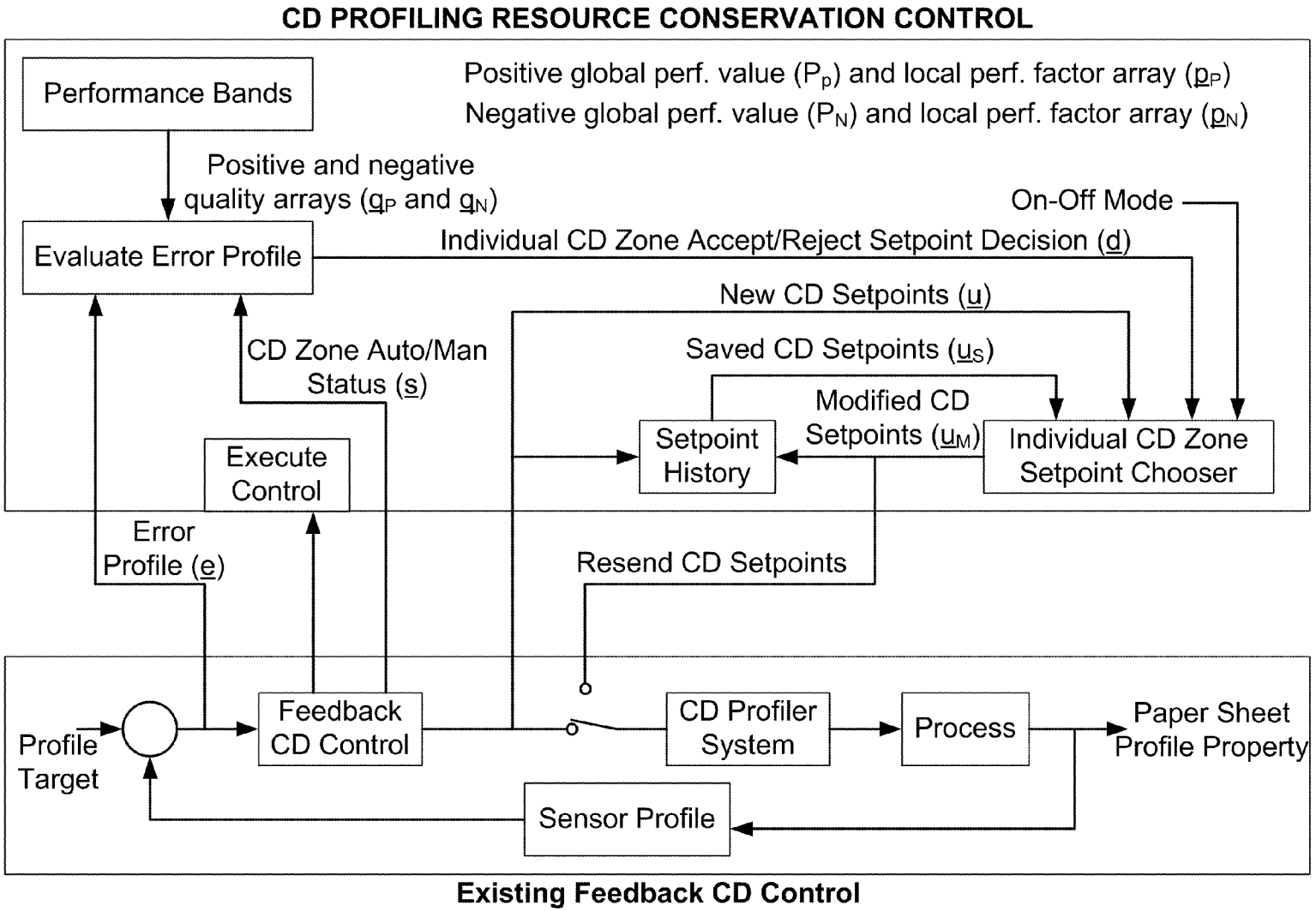
FIG. 5 shows the conservation control of the present invention integrated with a feedback CD control.

With reference to FIG. 5, integration of the conservation control with a feedback CD control is shown. The functionality of the conservation control requires certain information from the feedback CD. As shown in FIG. 5, the conservation control includes four inputs, the error profile, the zone status, an indication that new set-points are generated, and the new set-points.

As discussed above, the error profile is the difference profile array between the sensor profile array and the target profile reference array. In one or more embodiments, the error profile array includes the same number of elements as there are CD zones in the particular CD profiler system. Accordingly, the elements of the error profile array are aligned with the CD zones of the CD profiler. This one-to-one alignment identifies the error profile array region that the CD zone inflicts the most control influence on. This alignment is also known as control mapping.

The zone status is an array that the conservation control monitors and uses as one condition for accepting or rejecting the CD zone set-point value from the feedback control. The status array has as many elements as there are CD zones in the CD profiler system. In one or more embodiments, the status array indicates whether a particular zone is set to automatic or manual operation. Automatic status indicates that the feedback CD control automatically changes the set-point for the zone. Manual status indicates that the operator manually changes the set-point for the particular zone.

The new set-point indicator alerts the conservation control that the feedback CD control has executed and generated a new set of feedback CD control set-points. The set-point indicator alert triggers the conservation control to execute.

The new CD set-points are in an array with as many elements as there are CD zones in the CD profiler system. The new CD set-point array contains both the automatic control generated set-points and manual operator requested set-points.

The conservation control contains four main execution functions which include performance bands, evaluate error profile, individual CD zone set-point chooser and set-point history.

The conservation control is configured by adjusting the positive global performance value, positive local performance factor, the negative global performance value and negative local performance factor. In addition to the configuration parameters, the conservation control includes an on-off switch that allows the enabling and disabling of the conservation control. Disabling the conservation control essentially causes it to function as a pass-through, without affecting the CD set-points of the feedback CD control. In one or more embodiments, the feedback CD control may include a switch that selectively bypasses the output of the conservation control.

The conservation control is executed immediately, after the feedback CD control executes and generates its feedback CD control set-points. Depending on the state of the on-off switch, the conservation control either outputs modified CD set-points, or does nothing to alter the feedback CD control set-points.

The performance bands function computes a positive and negative performance band array for use in the evaluate error profile function. The performance band arrays have the same number of elements as CD zones in the CD profiler system and each element in the arrays has a one-to-one correspondence to a CD zone.

Figure 6:
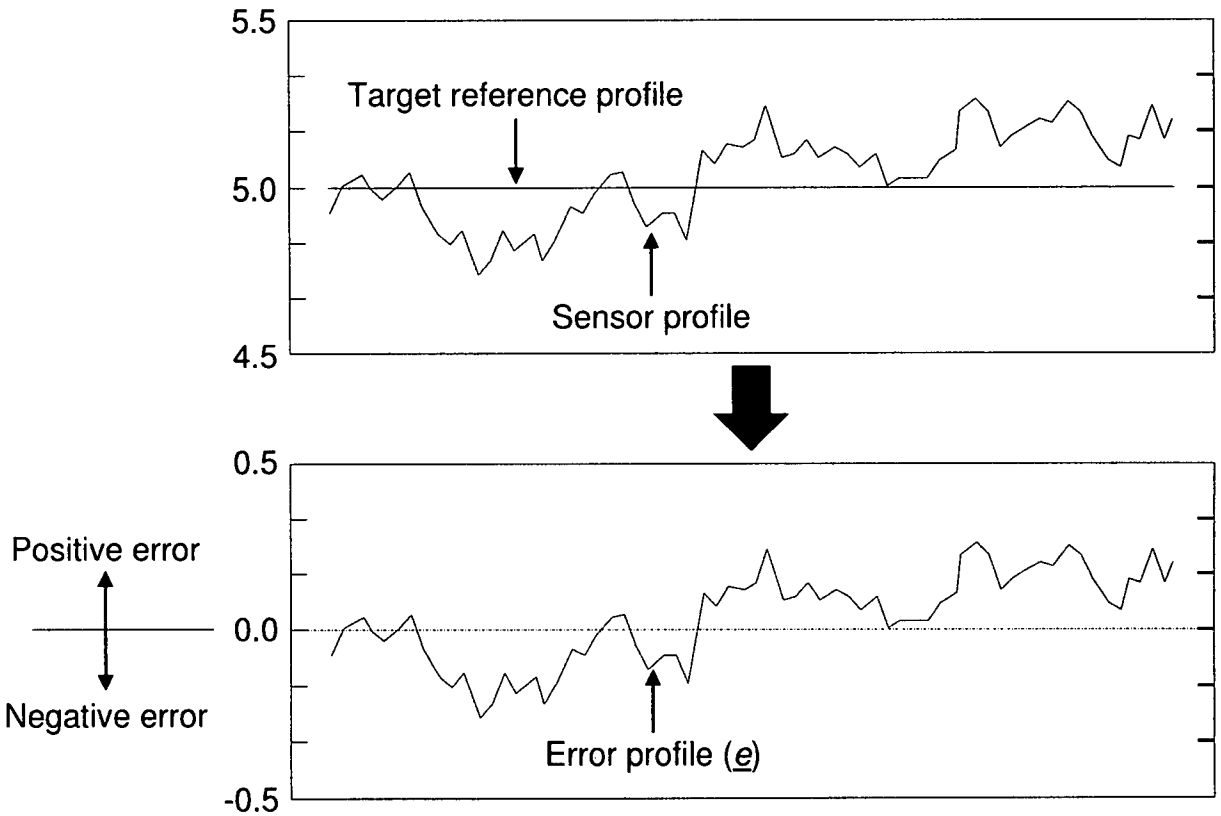
FIG. 6 shows a comparison of a sensor profile and an error profile.

The "positive" and "negative" labels are so named to reference the sign of the mapped error profile values. As discussed above, the error profile is an array that has the same number of elements as the number of CD zones, and this array is the difference between the sensed profile (from the sensor) and the target profile. Because the values of the array are computed from a difference operation, the resulting values can be positive, negative or zero. An array element value that is positive indicates that the sensor profile measurement segment corresponding to that array element is greater than its corresponding target value. An array element value that is negative indicates that the sensor profile measurement segment corresponding to that array element is less than its corresponding target value. An array element value that is zero indicates that the sensor profile measurement segment corresponding to that array element is at its corresponding target value. Positive and negative errors indicate that room for improvement exists. An exemplary sensor and target profile is shown in FIG. 6.

The performance band arrays are computed from the four configuration parameters using multiplication and absolute value operations. The positive and negative performance band arrays are computed from the configuration parameters according to the following:

Positive Performance Band Array $P_P$=global positive performance value $p_P(i)$=local positive performance factor for CD zone i, with value range of zero and greater and a default value of 1

$q_P(i)=|P_P \times p_P(i)|$=positive performance band value for CD zone i

Negative Performance Band Array $P_N$=global negative performance value $p_N(i)$=local negative performance factor for CD zone i, with value range of zero and larger and has a default value of 1

$q_N(i)=-1\times|P_N \times p_N(i)|$=negative performance band value for CD zone i The positive performance band array is computed with an absolute value function to ensure that all values in this array are 0 or greater. Likewise, the negative performance band array is computed with an absolute value function and post-multiplied by negative one (−1) to ensure that all values in this array are 0 or less. If the local performance factors are left at the default value of 1, then the values in the performance band will be the same across the entire array and will be equal to the global performance value. The local performance factors are available to allow for local individualized trade-off decision making.

Positive and negative performance band arrays are independently defined to achieve added flexibility. For example, if a CD rewet profiler is used to control the moisture profile then a negative performance band may be specified with the positive performance band set to zero (0). The negative performance band is used to accept feedback CD control corrections to add atomized water to error profile regions that are too dry until the error profile is within the negative performance band. While the zero positive performance band is used to always accept feedback CD control corrections to reduce atomized water to error profile regions that are wet. In this manner, the rewet profiler will tend to err toward using less water. Conversely, if a CD steam profiler is controlling a moisture profile, a positive performance band may be specified while the negative performance band is set to zero (0). In this latter example, the positive performance band is used to accept feedback CD control corrections to add superheated steam to error profile regions that are too wet until the error profile is within the positive performance band. The zero negative performance band is used to always accept feedback CD control corrections to reduce superheated steam to error profile regions that are dry. In this manner, the steam profiler will tend to err toward using less steam.

It should be appreciated that the performance bands of the conservation control only take affect when the local profile error is relatively near the target value. It is in this area, close to the target value, that control integration can cause output windup, particularly when multiple CD profilers are employed to control the same measurement profile. It should further be appreciated, that the performance bands do not take affect when the local profile error is large, as is typically the case during machine startup. Thus, the conservation control will not interfere with aggressive control execution when it is necessary for fast performance recovery during startups.

The four configuration parameters, the global positive and negative performance values and the local positive and negative performance factor arrays, are the only variables that are adjusted to tune or commission the conservation control. In the most simple case, the local positive and negative performance factor arrays are left at the default value of one (1) and the global positive and negative performance values are set in accordance to the examples described above to achieve reduction in operating cost for the type of profiling application employed to control the profile measurement. In choosing the values for the global positive and negative performance values, the initial setting for these values can be set to match or be slightly less than the product specification for the profile measurement. As an example, if the product specification for the moisture profile is defined as an absolute deviation from the average moisture, for instance ±0.2% M, then the initial setting for the global performance might be a value between 0.15 and 0.2. This range of values permits the control actions from feedback CD control to correct profile measurement errors up to, and slightly better, than the product specification.

The evaluate error profile function (see FIG. 5) compares the error profile to the performance band arrays and generates a decision array. The decision array has the same number of elements as CD zones in the CD profiler system and each element in the array has a one-to-one correspondence to a CD zone. The decision array is a two state array with each element in the array having either an "accept" or "reject" state. The accept state indicates that the new set-point value generated by the feedback CD control will be unmodified. The reject state indicates that the new set-point value generated by the feedback CD control will be replaced by the previous set-point value that is maintained in the set-point history buffer.

Figure 7:
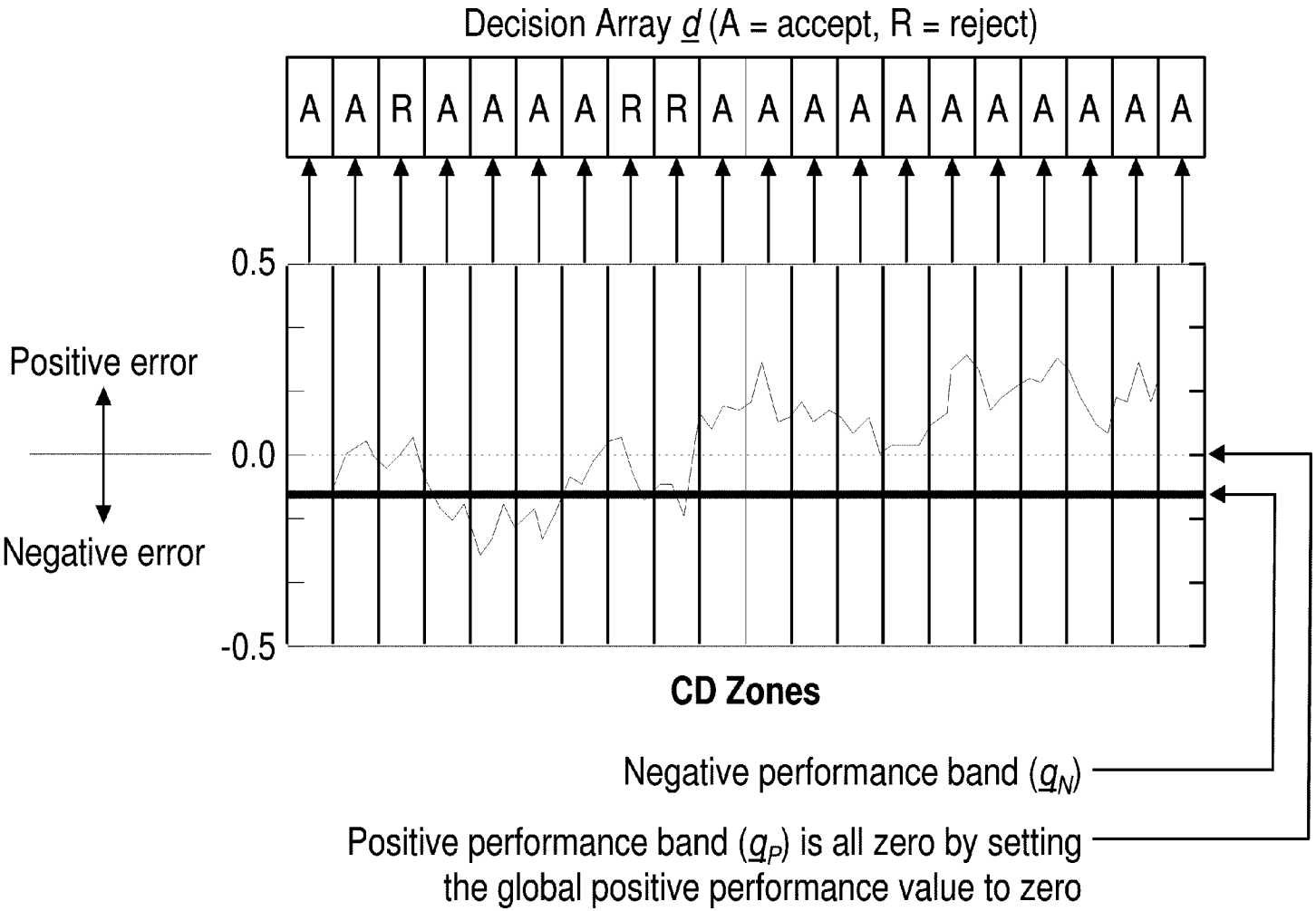
FIG. 7 shows an exemplary decision array.

With reference to FIG. 7, the accept state is selected for a CD zone if any of the following three statements are true, else the reject state is selected.

(1) The zone status of a particular CD zone is set to manual mode. In such an instance, the operator placed the CD zone in manual mode for the purpose of manually controlling the set-point value. Operator manual set-point control has the highest priority and is always honored.

(2) The error profile value for a CD zone is greater than its corresponding positive performance band value, where:
e(i)=error profile value for CD zone i
$q_P(i)$=positive performance band value for CD zone i
d(i)=decision accept state for CD zone i
If $e(i)>q_P(i)$, then d(i) is TRUE (3) The error profile value corresponding to a CD zone is less than the corresponding CD zone negative performance band, where:
e(i)=error profile value for CD zone i
$q_N(i)$=negative performance band value for CD zone i
d(i)=decision accept state for CD zone i
If $e(i)<q_N(i)$, then d(i) is TRUE The individual CD zone set-point chooser function (see FIG. 5) receives the decision array, constructs a modified solution to the CD set-point array and outputs this modified solution to the CD profiler system. The modified CD set-point array has the same number of elements as CD zones in the CD profiler system and each element in the array has a one-to-one correspondence to a CD zone. If the conservation control is enabled for operation via the on-off switch, then the modified CD set-point array is output to the CD profiler system. If the conservation control is not enabled for operation via the on-off switch, then no output is made to the CD profiler system from the conservation control. However, the set-point history is still updated to ensure seamless transfer operation when the conservation control is turned on. In this latter case, operation of the existing feedback CD control is unaffected, and the set-point array computed by the feedback CD control is directed to the CD profiler system.

Figure 8:
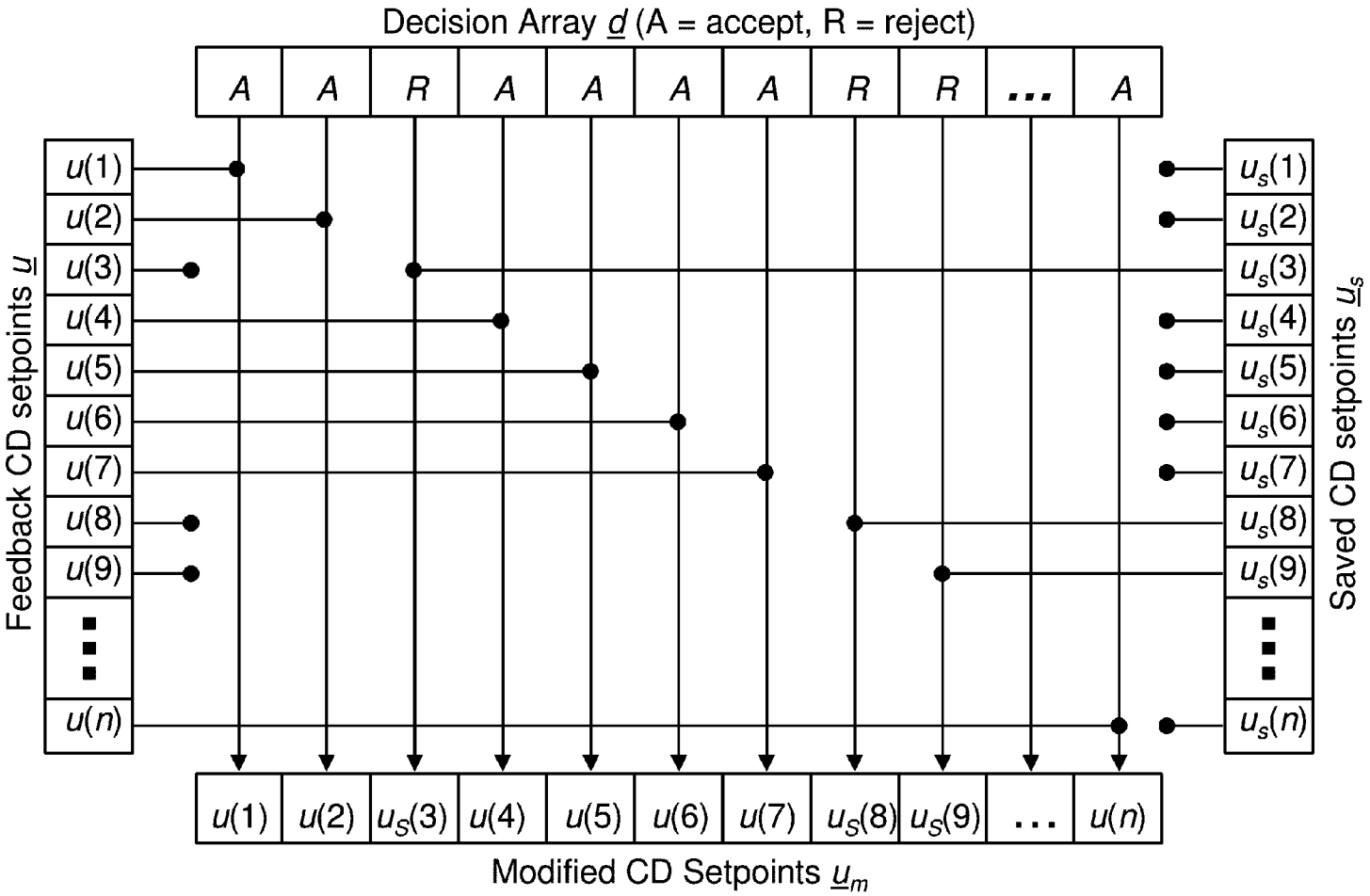
FIG. 8 shows the decision process of the set point chooser function.

With reference to FIG. 8, the modified CD set-point array is constructed from either the newly updated CD set-points (u) from the feedback control or from the set-points saved in the history buffer ($u_s$). The constructed set-point array is dependent on the decision array (d) computed from the evaluate error profile function and the status of the on-off switch of the conservation control. The rules used to construct the modified CD set-point are listed below in order of priority.

(1) If the conservation control is turned off, then the modified CD set-points ($u_m$) are set equal to the newly updated CD set-points (u) from the feedback CD control. The set-point history is updated with the modified CD set-points, but the modified CD set-points are not output (or resent) to the CD Profiler System.

$u_m = u$ $u_s = u_m$ (2) If the conservation control is turned on, the modified CD set-point elements ($u_m$) with a corresponding decision of "accept" are set to the newly updated CD set-points (u) from the feedback CD control. If the decision array indicates a rejection, modified CD set-point element ($u_m$) is set to the saved set-point values ($u_s$) from the set-point history buffer. The set-point history is updated with the modified CD set-points. The modified CD set-points are then output to the CD Profiler System.

The set-point history function serves the purpose of storing the modified CD set-points computed by the chooser function. The modified CD set-points are stored each time the conservation control executes, regardless of whether the modified CD set-points are output to the CD profiler system.

Figure 9:
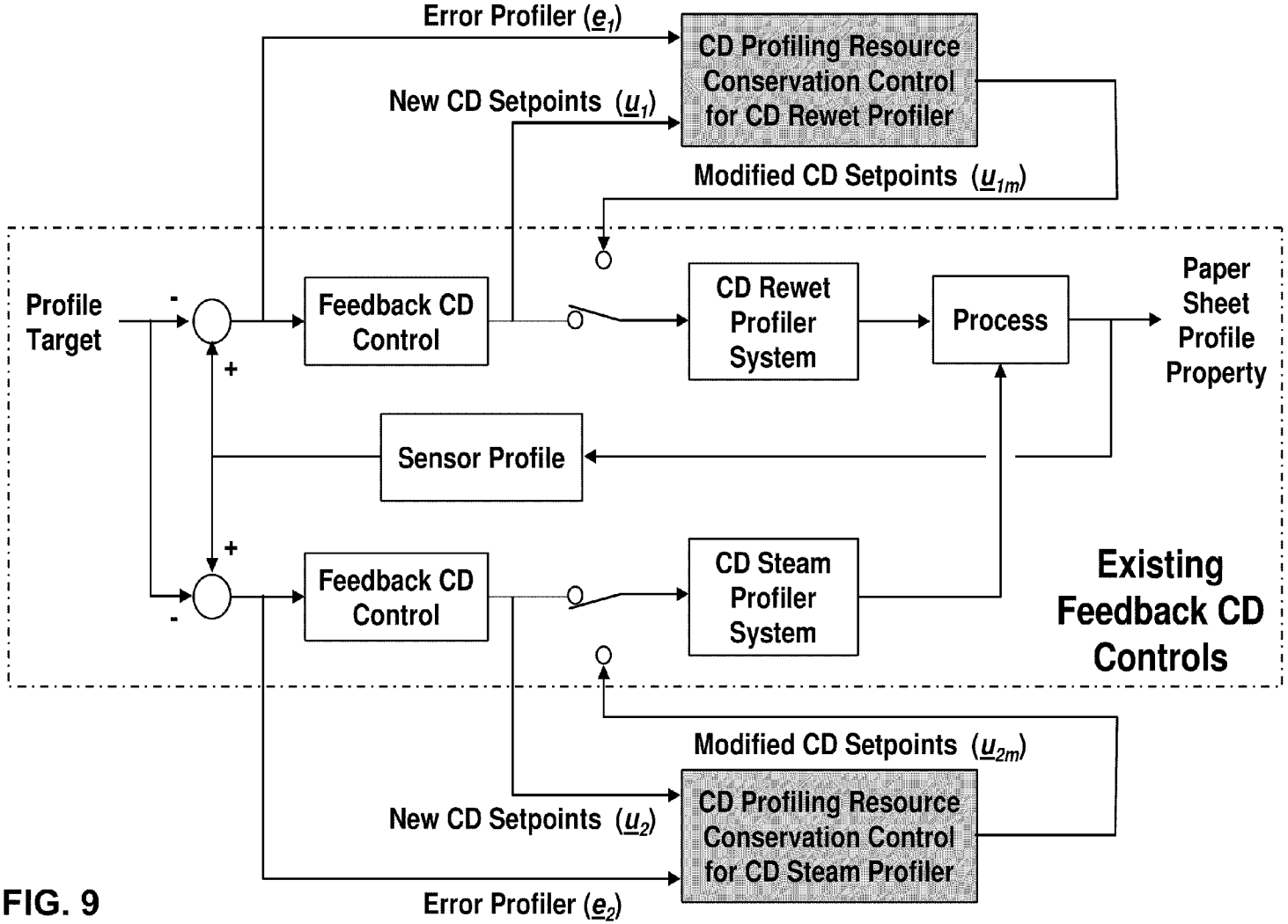
FIG. 9 shows the conservation control of the present invention integrated separately into a pair of feedback CD controls associated with a rewet profiler and steam profiler respectively.

The CD profiling conservation control was tested on a paper machine equipped with both a CD rewet profiler and CD steam profiler to control the same moisture profile measurement. The machine therefore has the profiling configuration that will often result in over use of profiling water, profiling steam and MD dryer section steam because of the interaction between all three actuators. The rewet profiler included 46 CD zones and the steam profiler had 94 CD zones. Because the conservation control operates with each profiler separately, the difference in number of CD zones is immaterial to proper functionality. Integration of the two conservation controls with the feedback CD controls is shown with reference to FIG. 9.

Performance was evaluated by monitoring the moisture error profiler standard deviation, average set-point output to the rewet profiler, average set-point output to the steam profiler, and MD steam section set-point. Two criteria were analyzed for the resource conservation control.

(1) Resource conservation focuses on how much the profiler average set-point output can be reduced when the conservation control is active. Reduction in the profiling resource usage and MD steam section usage is an indication of reduction in operating cost.

(2) Performance trade-off focuses on how much control performance is sacrificed by reducing the operating cost of the profiling resource.

Figure 11:
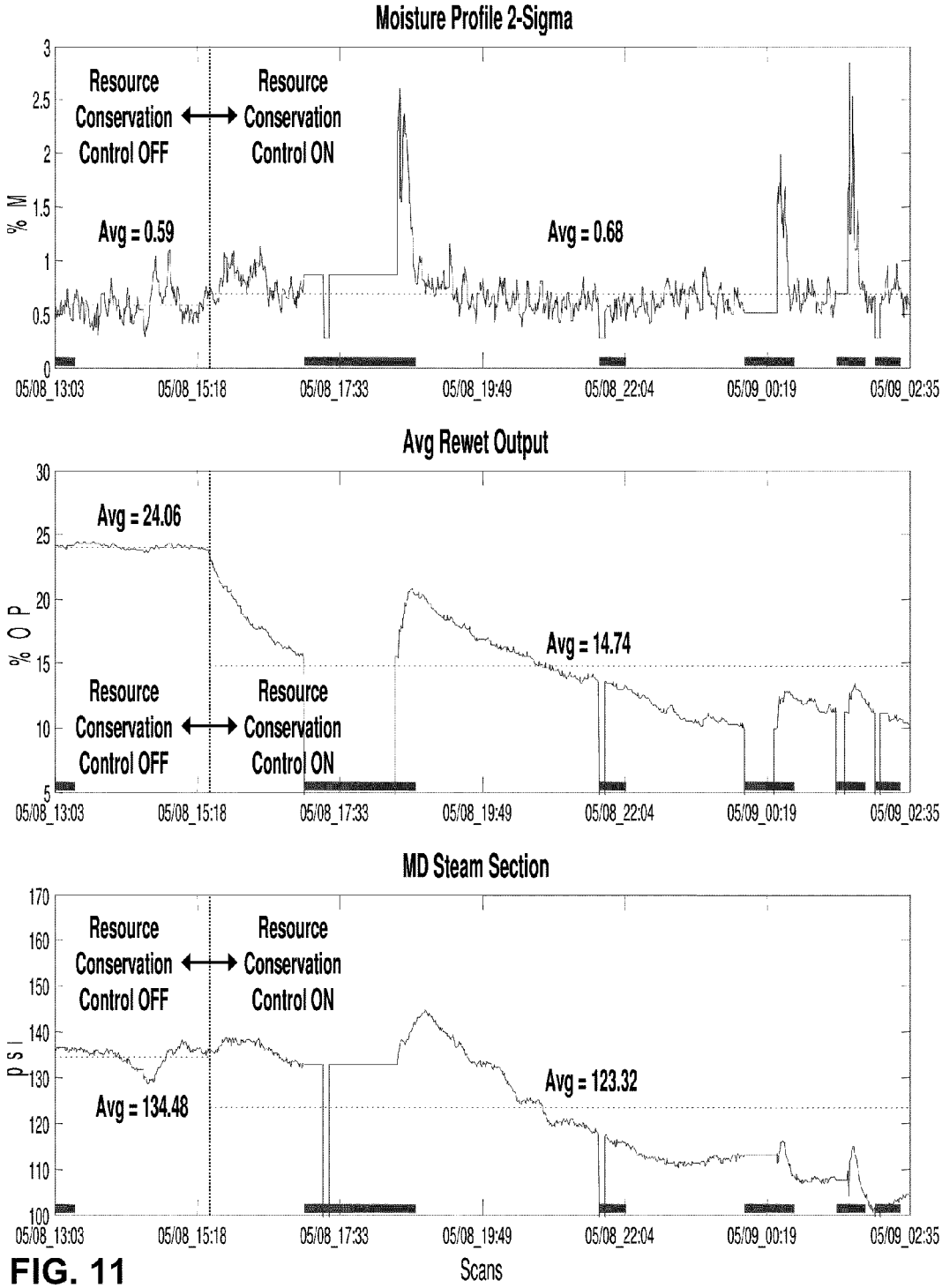
FIG. 11 shows performance trends indicative of the operation of a paper making machine employing the conservation control of the present invention, where reduction in water output from a rewet profiler results in reduction in steam usage from the main dryer section while the moisture profile performance is maintained.

Results from applying the resource conservation control to this paper machine and the two CD profiling configuration are presented in the following table. Trends of the process variables monitored to evaluate the performance of this control are also shown in FIGS. 10-12.

From a resource conservation perspective, the control showed significant savings in operating costing. For the rewet and steam profiler application of the resource conservation control, the profiler resource usage was reduced by 39% and 15% respectively. Additionally, the resource usage of MD steam section was reduced by 8%. By using steam more efficiently, the machine may be sped up, thereby increasing productivity.

From a performance trade-off perspective, the steam profiler application of the conservation control showed negligible change in the moisture profile variable, while the rewet profiler application of the conservation control showed an increase of 13%. While 13% appears as a significant increase, this represents only a 0.07 shift in the moisture profiler measurement variability. To reduce this trade-off increase, the resource conservation control negative global performance level may be made smaller to allow more of the feedback CD control actions to be sent to the CD rewet profiler system.

It is to be understood that the description of the preferred embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

We claim:

1. A conservation control method for integration with a feedback cross-machine direction control system, the feedback cross-machine direction control system includes a cross-machine direction controller and a cross-machine direction profiler operable to directly modify the properties of a web being produced in the machine direction, said web properties measured and modified after the formed web has exited a headbox, said conservation control method comprising:

receiving an error profile representing a web property, said error profile including a plurality of cross-direction zones;

receiving a first cross-direction set-point array from the feedback cross-direction controller, said first cross-direction set-point array including a plurality of first set-point values, each said first set-point value correlating to one of said cross-direction zones;

determining a performance band;

creating a decision array having a plurality of decision array values, where each said array value correlates to one of said cross-direction zones, and for each cross-direction zone if said error profile is outside said performance band, said decision array value correlating to that cross-direction zone is set to accept and if said error profile is inside said performance band, said decision array value correlating to that cross-direction zone is set to reject;

creating a modified cross-direction set-point array, said modified cross-direction set-point array including a plurality of modified set-point values, each of said modified set-point values correlating to one of said cross-direction zones, wherein for every cross-direction zone labeled accept in said decision array, the corresponding modified set-point value is set to the first set-point value correlating to that cross-direction zone and for every cross-direction zone labeled reject in said decision array, the corresponding modified set-point value is set to a previously stored set-point value; and transmitting said modified cross-direction set-point array to the cross-direction profiler.

2. The conservation control method according to claim 1 wherein said performance band includes a negative performance band array and a positive performance band array and wherein each said negative and positive band array includes the same number of elements as the number of cross-direction zones.

3. The conservation control method according to claim 2 wherein said negative performance band array includes a plurality of negative performance band values and said positive performance band array includes a plurality of positive performance band values and wherein each said positive and negative performance band value may be determined independently.

4. The conservation control method according to claim 1 further comprising storing said modified cross-direction set-point array each time said modified cross-direction set-point array is created and selecting said previously stored set-point value from the stored modified cross-direction set-point array.

5. A conservation control system for integration with a feedback cross-machine direction controller associated with a cross-machine direction profiler operable to directly modify the properties of a web being produced in the machine direction, said web properties measured and modified after the formed web has exited a headbox, said conservation control system comprising:

means for receiving an error profile, said error profile including a plurality of cross-direction zones;

means for receiving a first cross-direction set point array from said feedback cross-direction control, said first cross-direction set-point array including a plurality of first set-point values, each said first set-point value correlating to one of said cross-direction zones;

means for determining a performance band;

means for creating a decision array having a plurality of decision array values, where each said decision array value correlates to one of said cross-direction zones, and for each cross-direction zone if said error profile is outside said performance band, said decision array value correlating to that cross-direction zone is set to accept and if said error profile is inside said performance band, said decision array value correlating to that cross-direction zone is set to reject;

means for creating a modified cross-direction set-point array, said modified cross-direction set-point array including a plurality of modified set-point values, each of said modified set-point values correlating to one of said cross-direction zones, wherein for every cross-direction zone labeled accept in said decision array, the corresponding modified set-point value is set to the first set-point value correlating to that cross-direction zone and for every cross-direction zone labeled reject in said decision array, the corresponding modified set-point value is set to a previously stored set-point; and means for transmitting said modified cross-direction set-point array to the cross-direction profiler.

6. The conservation control system according to claim 5 wherein said performance band includes a negative performance band array and a positive performance band array and wherein each said negative and positive band array includes the same number of elements as the number of cross-direction zones.

7. The conservation control system according to claim 6 wherein said negative performance band array includes a plurality of negative performance band values and said positive performance band array includes a plurality of positive performance band values and wherein each said positive and negative performance band value may be determined independently.

8. The conservation control system according to claim 5 further comprising a means for storing said modified cross-direction set-point array each time said modified cross-direction set-point array is created and selecting said previously stored set-point value from the stored modified cross-direction set-point array.

9. A conservation control system for integration with a feedback cross-machine direction control system, the feedback cross-machine direction control system includes a cross-machine direction controller and a cross-machine direction profiler operable to directly modify the properties of a web being produced in the machine direction, said web properties measured and modified after the formed web exits a headbox, said conservation control system comprising:

an evaluate error profile module for receiving an error profile representing a web property, said error profile including a plurality of cross-direction zones, said evaluate error profile module receiving a first cross-direction set-point array from the feedback cross-direction controller, said first cross-direction set-point array including a plurality of first set-point values, each said first set-point values correlating to one of said cross-direction zones, said evaluate error profile module further receiving a performance band, said evaluate error profile module adapted to create a decision array having a plurality of decision array values, where each said decision array value correlates to one of said cross-direction zones, and for each cross-direction zone if said error profile is outside said performance band, said decision array value correlating to that cross-direction zone is set to accept and if said error profile is inside said performance band, said decision array value correlating to that cross-direction zone is set to reject; and an individual cross-direction zone set-point chooser for creating a modified cross-direction set-point array, said modified cross-direction set-point array including a plurality of modified set-point values, each of said modified set-point values correlating to one of said cross-direction zones, wherein for every cross-direction zone labeled accept in said decision array, the corresponding modified set-point value is set to the first set-point value correlating to that cross-direction zone and for every cross-direction zone labeled reject in said decision array, the corresponding modified set-point value is set to a previously stored set-point value, said individual cross-direction zone set-point chooser adapted to transmit said modified cross-direction set-point array to the cross-direction profiler.

10. The conservation control system according to claim 9 wherein said performance band includes a negative performance band array and a positive performance band array and wherein each said negative and positive band array includes the same number of elements as the number of cross-direction zones.

11. The conservation control system according to claim 10 wherein said negative performance band array includes a plurality of negative performance band values and said positive performance band array includes a plurality of positive performance band values and wherein each said positive and negative performance band value may be determined independently.

12. The conservation control system according to claim 9 further comprising storing said modified cross-direction set-point array each time said modified cross-direction set-point array is created and selecting said previously stored set-point value from the stored modified cross-direction set-point array.

13. A conservation control method for integration with a feedback cross-machine direction control system, the feedback cross-machine direction control system includes a cross-machine direction controller and a cross-machine direction profiler operable to directly modify the properties of a web being produced in the machine direction, said web properties measured and modified after the formed web has exited a headbox, said conservation control method comprising:

receiving an error profile having a plurality of cross-direction zones;

receiving a set of first cross-machine set-points from the feedback cross-machine direction controller;

determining a range for evaluation of error profile values corresponding to said cross-direction zones;

outputting a set of modified cross-machine set-points to the cross-machine direction profiler wherein if the error profile for a given cross-direction zone is outside a said predetermined range, the corresponding set-point in the modified cross-direction set-points is the value of the corresponding set-point in the first cross-machine set-points and if the error profile for a given cross-direction zone is inside said predetermined range, the corresponding set-point in the modified cross-direction set-points is set to a previously stored value; and transmitting said modified cross-direction set-points to the cross-direction profiler.

* * * * *